United States Patent [19]

Drejza et al.

[11] Patent Number: 4,569,610

[45] Date of Patent: Feb. 11, 1986

[54] MULTI-FUNCTION DOCUMENT TRANSPORT SYSTEM FOR PRINTERS

[75] Inventors: John E. Drejza; Matthew J. Galatha, both of Charlotte, N.C.

[73] Assignee: International Business Machines Corporation, Armonk, N.Y.

[21] Appl. No.: 616,804

[22] Filed: Jun. 4, 1984

[51] Int. Cl.[4] ..... B41J 11/48

[52] U.S. Cl. ..... 400/599; 400/616.3; 400/636

[58] Field of Search ..... 400/595, 599, 607.2, 400/616.3, 617, 636

[56] References Cited

U.S. PATENT DOCUMENTS

| | | | |
|---|---|---|---|
| 4,164,376 | 8/1979 | Yarp | 400/642 |
| 4,197,023 | 4/1980 | DeBoo et al. | 400/578 |
| 4,341,480 | 7/1982 | Mailer | 400/636 X |
| 4,417,825 | 11/1983 | Cushman et al. | 400/605 |
| 4,452,543 | 6/1984 | Adkisson et al. | 400/605 |
| 4,475,833 | 10/1984 | Sawicki | 400/605 |

FOREIGN PATENT DOCUMENTS

| | | | |
|---|---|---|---|
| 526663 | 10/1954 | Belgium | 400/616.3 |
| 0073578 | 3/1983 | European Pat. Off. | 400/616.3 |
| 0156285 | 9/1982 | Japan | 400/599 |
| 0089388 | 5/1983 | Japan | 400/636 |
| 557067 | 7/1973 | Switzerland | 400/607 |

*Primary Examiner*—Edgar S. Burr
*Assistant Examiner*—John A. Weresh
*Attorney, Agent, or Firm*—Bell, Seltzer, Park & Gibson

[57] ABSTRACT

The document transport system includes improved document drive and guide means to permit the optional feeding of a continuous web document or the feeding of individual cut form documents through the printer. A continuous web document can be fed through the printer in two feeding modes and cut form documents can also be fed through the printer in two feeding modes. Document guide means is provided for feeding documents inwardly from the top or front of the printer and both pin wheel and friction type drive means are provided.

8 Claims, 5 Drawing Figures

MULTI-FUNCTION DOCUMENT TRANSPORT SYSTEM FOR PRINTERS

FIELD OF THE INVENTION

This invention relates generally to a multi-function document transport system for computer output printers and more particularly to a document transport system including improved document drive and guide means to permit the optional feeding of a continuous web type document or the feeding of individual cut form type documents.

BACKGROUND OF THE INVENTION

Currently available computer output printers are normally provided with one type of document feeding and guide means for advancing a document of the continuous web type through the printing station or a different type of document feeding and guiding means for advancing individual cut form type documents through the printing station. The ability to print only a document of the continuous web type or individual cut form type documents thus limits the versatility and use of the particular printer to only a single mode of operation. Certain presently available printers may be used to feed either a document of the continuous web type or individual cut form type documents but require that the operator make certain adjustments of the pin or spur drive wheels used to drive the document of the continuous web type and/or require adjustment of the friction rolls used to drive the cut form type documents. In printers in which the continuous web type documents and the cut form documents follow the same feed path into the printer, the continuous web type document must be completely removed before the printer can be adapted for use in printing individual cut form documents, such as precut sheets, including letterhead stationery and the like or envelopes, and this required removal of the continuous web type document is time consuming and bother-some to the operator.

U.S. Pat. No. 4,417,825 discloses a document driving and guide arrangement for high-speed printers which includes both pin wheel driving means and friction roll drive means for alternately advancing either a continuous web type document or individual cut form documents through the printing station of the printer. The document feeding arrangement of this patent includes a shifting lever which must be actuated by the operator to selectively feed either the continuous web type document or individual cut form documents. The switching of the lever by the operator changes the document driving mechanism so that it operates in either a friction drive mode or a spur or pin wheel drive mode. The drive mode shifting lever and the associated mechanism adds to the cost of producing the printer and also complicates the operation of the printer. In either drive mode, the two different types of documents follow the same path of travel into the printer so that the continuous web type document must be removed before the individual cut form documents can be fed to the printer.

U.S. Pat. No. 4,164,376 discloses a printer including a multiple path paper feed system which permits the feeding of a continuous web type document from the front, bottom or rear of the printer housing. The optional paper or document feed paths are provided to permit installation of the printer and location of the document supply source in a position that is most comfortable and convenient for placement of the printer and for operator placement. However, the document feeding means of this printer is disclosed as being of the pin or spur wheel type adapted to feed only continuous web type documents having uniformly spaced perforations along its outer edges. The feed means of this printer is positioned downstream of the printer head and platen so that this printer is not adaptable for feeding individual cut form documents.

Currently available output printers have the head supported for back and forth transverse movement in a horizontal plane with the platen supported in a vertical plane and this arrangement tends to increase the overall height of the printer, and to prevent the manual feeding of relatively short cut form documents, such as envelopes, into the printer. The nip of the document feed rolls is usually located a distance of one or more inches downstream of the print line so that the first and last lines of print on cut form documents must be spaced corresponding distances from the respective leading and trailing edges of the document.

SUMMARY OF THE INVENTION

With the foregoing in mind, it is an object of the present invention to provide a document transport system for a printer to permit the optional feeding of either a document of the continuous web type or the feeding of individual cut form type documents through the printer and wherein the document transport system is simple in construction and operation and requires no substantial intervention on the part of the operator to convert the printer from the feeding of one type of document to the other.

It is another object of the present invention to provide a document transport system for printers with improved guide means including first guide path means for directing a continuous web document along a first path of travel and to the printing station, and second guide path means for directing individual cut form documents along a second path of travel and to the printing station so that individual cut form documents can be fed to the printer while a continuous web document remains in the printer.

In accordance with the present invention, friction roll driving means is positioned immediately in advance of the printing station for advancing both types of documents between the print head and the platen, and pin wheel driving means is positioned in advance of the friction roll driving means for guidingly advancing a document of the continuous web type to the friction driving means. Document guide means is provided for permitting the optional feeding of a document of the continuous web type or the feeding of individual cut form documents.

The document guide means includes first guide path means for directing uniformly spaced pin feed holes in the outer edges of the continuous web document through the printer in a first feeding mode and along a first path of travel and into engagement with the pin wheel driving means, then between the friction roll drive means, through the printing station, and then out of the printer. The continuous web type document can also be fed through the printer in a second feeding mode. In this second feeding mode, the continuous web follows the same first path of travel as that described in the first feeding mode except that the pin feed holes are guided back into engagement with the pin wheel driving means after the continuous web document leaves the printing station and prior to being fed out of the printer. This second feeding mode provides positive driving engagement of the continuous web document both upstream and downstream of the printing station. The distance between the entry and exit points of the pins on the pin wheel driving means is slightly greater than the corresponding distance between the pin feed holes in the continuous web document so that the document is maintained under positive tension during the printing operation. This second feed mode also permits positive reverse feeding of the continuous web document.

Second guide path means is provided for directing individual cut form documents along a second path of travel directly into the friction roll driving means to thereby bypass the pin wheel driving means. The second guide path means also permits the feeding of cut form documents through the printer in selected first or second feeding modes. The first feeding mode is provided to permit cut form documents to be fed to the printer either manually or from an automatic cut form document feeder. In the first feeding mode, the document is fed into the top of the printer and along a path of travel spaced rearwardly of the path of entry of the continuous web document so that the cut form document is not engaged by the pin wheel driving means but is guided directly into the friction roll driving means and then through the printing station. In the second feeding mode, the cut form document is manually fed into the front of the printer and along a path of travel directly into the friction roll driving means. This second feeding mode for cut form documents is of particular value when letters are printed on stationery and an envelope is then fed to the printing station for imprinting the address of the recipient thereon.

The print head of the present printer is supported at a downwardly inclined angle of approximately 30 degrees so that the forward end of the upper guide for directing the cut form documents inwardly from the front of the printer can be widely separated above the lower guide to provide an open "mouth" extending across the front of the printer. This open mouth permits entry of the fingers of the operator into the front of the printer so that the leading edge of short cut form documents, such as envelopes, can be fed directly into the nip of the friction drive rolls. Also, the nip of the friction drive rolls is positioned within approximately one-half of an inch of the print line so that the first and last lines of print on cut form documents can be formed within approximately one-half inch of the respective leading and trailing edges of the document.

In the illustrated embodiment, documents can be fed through the printer in four different feeding modes to provide improved versatility to the printer. In the first and second feeding modes for a continuous web document, the continuous web document is fed into the printer from the top. In the first feeding mode for the cut form documents, the cut form documents are fed into the printer from the top and along a different entry path from the continuous web document. In the second feeding mode for the cut form documents, the cut form documents are fed into the printer from the front and are guided directly into the friction roll driving means.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
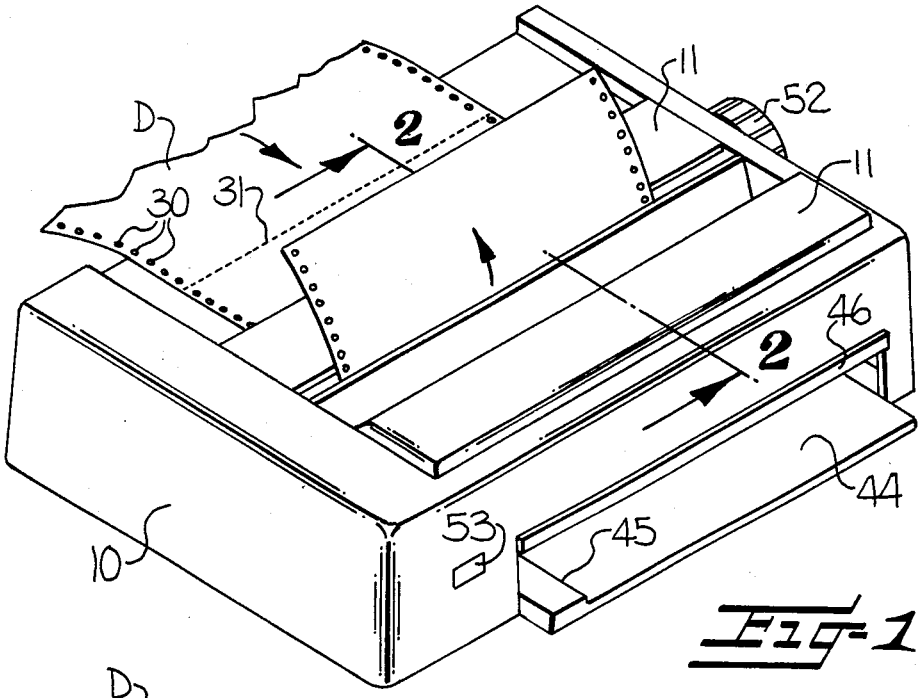
FIG. 1 is an isometric view of the printer, illustrating a continuous web type document being printed thereby.

The multifunction document transport system of the present invention is illustrated in association with an output printer for a computer or a data processing machine including an outer housing 10 with a removable access cover 11 supported on the upper surface of the housing 10 to provide access to the document guiding and printing mechanism supported beneath the cover 11. The present document transport system is incorporated in a printer frame assembly having snap-together molded plastic parts that may be readily assembled with robotic techniques. The details of the frame assembly are disclosed in copending application Ser. No. 619,228, filed June 11, 1984. Only so much of the printer frame assembly is illustrated in the present disclosure as is necessary for an understanding of the present invention and reference may be made to said copending application for any details of the printer frame assembly which are necessary.

The printer frame assembly includes a base 12 and opposite end frames supported on and extending upwardly therefrom. The printer includes a printing station having printer means, illustrated as a wire matrix print head 13, for recording data on a document. A platen 14 extends across the width of the printer and opposite ends are supported in the end frames with the forward portion of the platen 14 being supported in right-angular alignment with the print head 13 so that the document moves across the front face of the platen 14 and between the platen 14 and the print head 13 during its travel through the printing station.

The print head 13 is supported for transverse movement back and forth across the printer on a guide bracket 16 supported at its forward and rearward ends on guide rods 17, 18. The guide bracket 16 is moved back and forth across the printer by a worm-type screw 20 which is driven by a suitable stepping motor, not shown. A ribbon cartridge 22 is removably supported above the guide bracket 16 for feeding a ribbon between the print head 13 and the document to form the printed indicia on the document when the ribbon is engaged by the print wires in the print head 13.

Friction roll driving means is positioned immediately in advance of the printing station for advancing the document between the print head 13 and the platen 14. The friction roll driving means includes a plurality of friction roll segments 24 of a relatively small diameter supported on and driven by a drive shaft 25. The friction roll segments 24 are spaced across the width of the printer and supported immediately below the path of back and forth movement of the print head 13 so that the surface of the friction roll segments 24 engage one face of the document immediately prior to the printing line being formed by the print head 13. Friction roll segments 26 are spaced across the width of the printer and engage the opposite face of the document, in alignment with the friction roll segments 24. The friction roll segments 26 are larger in diameter than the friction roll segments 24 and are supported on and driven by a drive shaft 27 which is drivingly connected by suitable gears, not shown, to the friction roll drive shaft 25.

Documents are guided, in a manner to be presently described, into the nip between the small friction drive roll segments 24 and the large friction drive roll segments 26 and are fed thereby through the printing station and between the print head 13 and the platen 14. The friction roll segments 24 are about one-half the size of the friction roll segments 26 so that the friction roll segments 24 can be positioned closely beneath the path of travel of the print head 13 and the document feeding nip is immediately downstream of the printing line. It will be noted that the document feeding nip of the friction drive rolls 24, 26 is positioned immediately in advance of the print line, preferably within about one-half inch, so that positive control of the document is maintained at a point immediately adjacent and in advance or downstream of the print line. This arrangement permits printing on cut form documents within about one-half inch of the leading and trailing edges of the documents.

Pin wheel driving means is positioned in advance of the friction roll driving means for advancing a document of the continuous web type, as indicated at D in FIG. 1. The continuous web document D has uniformly spaced pin feed holes 30 along its outer edge portions and transversely extending perforated tear lines 31 in spaced-apart relationship along the length of the continuous web document D. The pin wheel driving means includes a pair of pin wheels 33, only one of which is shown in FIGS. 2–5, including uniformly spaced outwardly projecting pins 34. The pin wheels 33 are supported for longitudinal adjustment on a square drive shaft 35 by corresponding support assemblies, broadly indicated at 36. The support assembly 36 is maintained in an adjusted position on the drive shaft 35 and a guide support shaft 38. The drive shaft 35 for the pin wheels 33 is drivingly connected through suitable gearing, not shown, to the drive shafts 25, 27 supporting the friction drive roll segments 24, 26. The friction drive roll segments 24, 26 are mounted for slipping engagement on the respective drive shafts 25, 27. The drive shafts 25, 27 are rotated so that the surfaces of the roll segments 24, 26 move at a slightly faster speed than the surface of the pin wheels 33. This maintains tension on the continuous web document D between the pin wheel 33 and the roll segments 24, 26 and also maintains the document in firm engagement with the lower surface of the roll segment 26 as it passes beneath the same.

Figure 2:
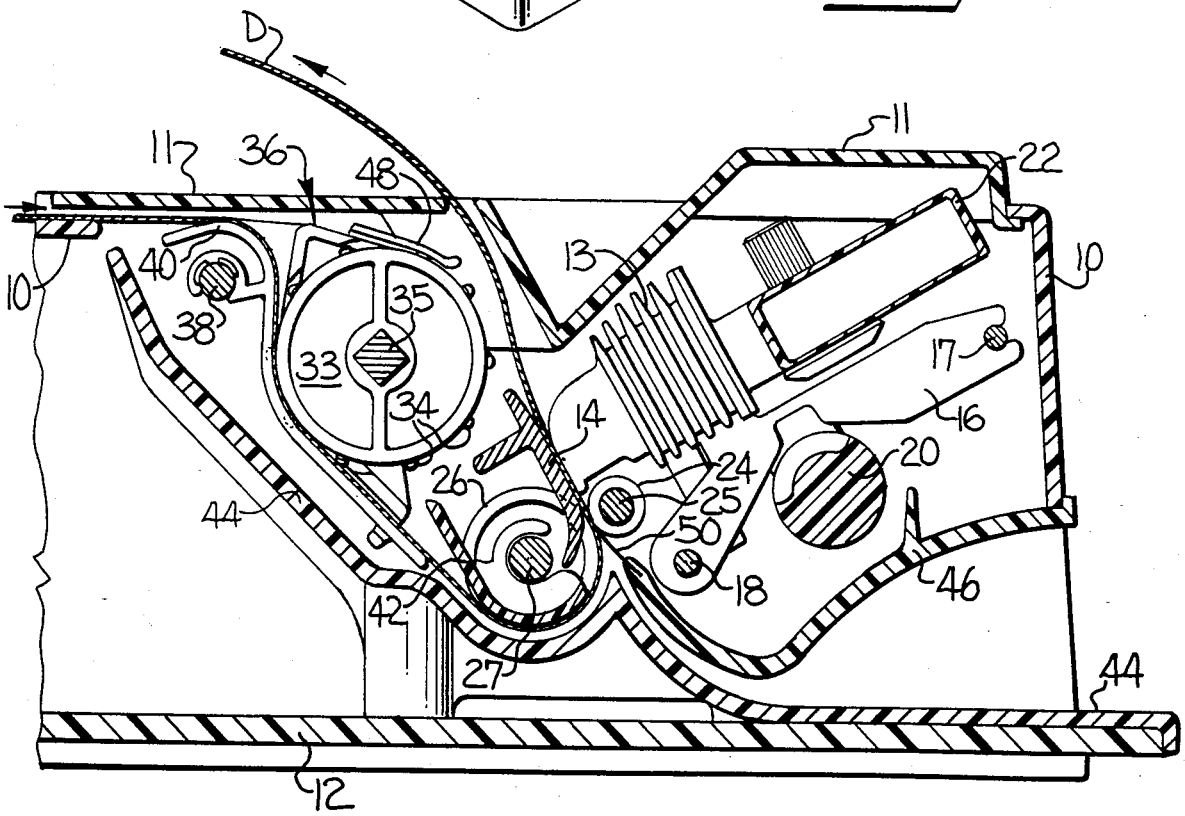
FIG. 2 is an enlarged vertical fragmentary sectional view taken substantially along the line 2—2 in FIG. 1 and illustrating the path of travel of the continuous web document in a first feeding mode.
Figure 3:
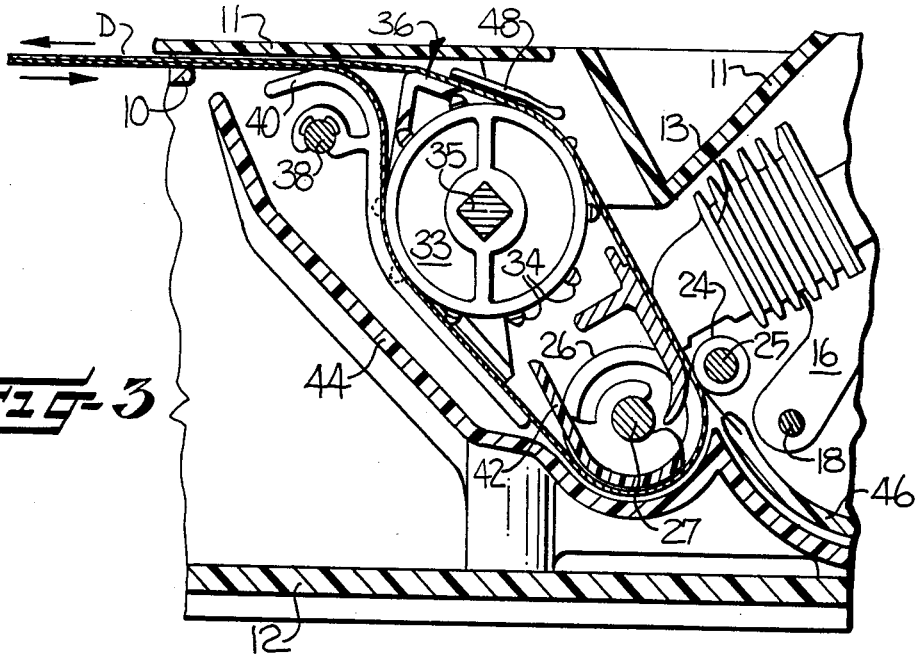
FIG. 3 is a view similar to FIG. 2 but illustrating the continuous web document being fed in a second feeding mode.
Figure 4:
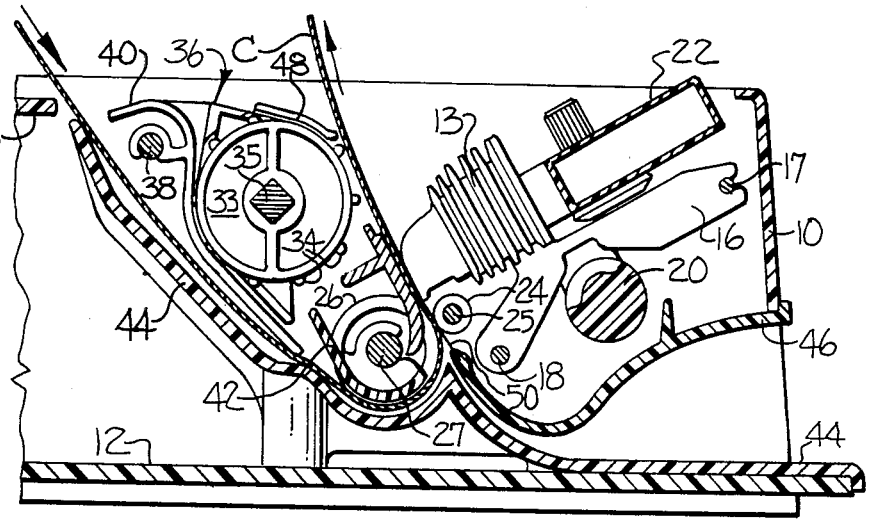
FIG. 4 is a view similar to FIGS. 1 and 2, but on a reduced scale, and illustrating the manner in which a cut form document is guided through the printer in a first feed mode.
Figure 5:
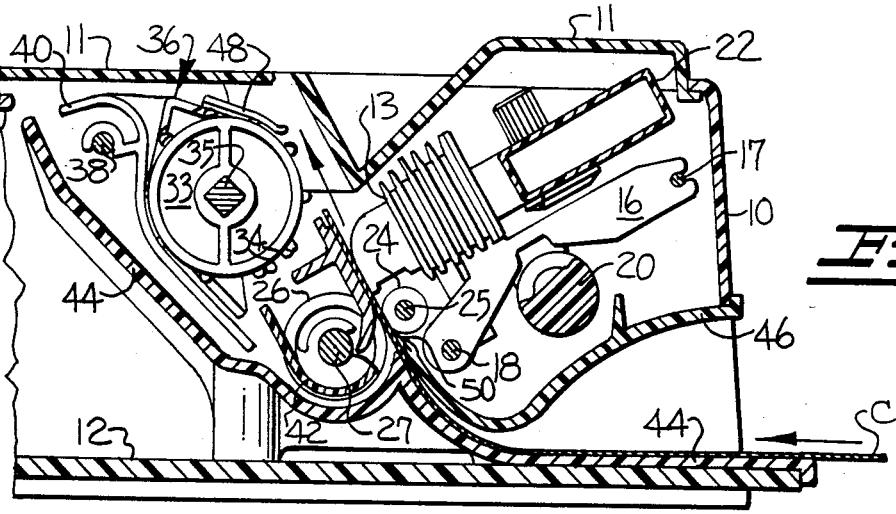
FIG. 5 is a view similar to FIG. 4 but illustrating a cut form document being fed from the front of the printer and guided through the printer in a second feeding mode.

Document guide means is provided for facilitating the optional feeding of a continuous web document, as indicated at D in FIGS. 1–3, or the feeding of individual cut form documents, as indicated at C in FIGS. 4 and 5. The document guide means includes a first guide path for directing a continuous web document D along selected first or second paths or modes of travel. The document guide means also provides a second guide path for directing individual cut form documents C along selected first or second paths or modes of travel. Thus, documents can be fed through the printer in four different feeding modes to provide improved versatility to the printer.

FIG. 2 illustrates the manner in which a continuous web document D is fed through the printer in a first feeding mode. In this first feeding mode, the continuous web document D is guided from a fan-folded stack or from a continuous roll supply and along the upper surface of the rear portion of the housing 10. The continuous web document D extends beneath the rear edge portion of the access cover 11 and then downwardly around a curved path of travel over a first curved guide plate 40 which is formed integral with the support assembly 36 and extends inwardly in closely spaced relationship with the rear peripheral surface of the pin wheel 33. The medial portion of the guide plate 40 closely follows the contour of the rear portion of the pin wheel 33 and is slotted to permit passage of the pins 34 therethrough so that the pin feed holes 30 are engaged by the pins 34.

The guide plate 40 then extends downwardly at an angle from the pin wheel 33 and directs the document D beneath the lower peripheral surface of the large friction drive roll 26. A curved guide plate 42 is supported on the drive shaft 27 and extends between each of the friction wheel drive roll segments 26. The guide plate 42 is curved at its lower portion at substantially the same radius as the outer peripheral surface as the drive roll 26 to aid in guiding the document therebeneath as it is fed downwardly by the lower end portion of the guide plate 40.

A molded lower guide plate 44 extends transversely from one side to the other of the printer and is supported on the base 12 to extend beneath the feed rolls and the printing station. The upper rear portion of the guide plate 44 is positioned rearwardly of and spaced from the guide plate 40 and pin wheels 33, for purposes to be presently described. The medial lower portion of the guide plate 44 includes a curved segment which is spaced from and follows the curved configuration of the lower surface of the friction drive roll 26 for initially guiding the leading end of the continuous web document D around the drive roll 26 and into the nip of the friction drive rolls 24, 26. The forward end of the lower guide plate 44 curves downwardly and extends along the base 12 to the front of the printer. The upper left-hand portion of the lower guide 44 is provided with a stepped guide edge 45 (FIG. 1), for purposes to be presently described. Guide plates 48, only one of which is shown in FIG. 2, are formed integrally with the pin wheel support assembly 36 and overlie the upper forward portion of the pin wheel 33, for purposes to be presently described.

The lower edge portion of the platen 14 is also provided with downwardly extending and rearwardly curving portions which extend between the large friction roll segments 26 to aid in guiding the portions of the document D between the friction drive roll segments 26 and upwardly into the nip between the friction drive rolls 24, 26. An upper front guide plate 46 extends transversely across the printer and includes a forward downwardly curved portion spaced above the forward portion of the lower guide 44 to form a relatively wide opening or "mouth" on the front panel of the housing 10, for purposes to be presently described. The rearward portion of the upper front guide 46 curves upwardly closely adjacent to the upward curving portion of the lower guide 44 and has an upper edge which supports an upwardly extending plastic sheet guide 50 having segmented portions extending upwardly beyond the nip of the friction drive rolls 24, 26, for purposes to be presently described.

While the continuous web document D is passing through the friction feed roll nip, the document is also engaged by the plastic sheet guide 50 to maintain one side of the document in close contact with the lower curved segments of the platen 14 and to maintain the document in flat condition as it passes the printing line. The plastic sheet guide 50 is of particular value if a multiple copy type of continuous web document D is being fed through the printer. In this instance, the plastic sheet guide 50 presses the air from between the sheets just before printing of the document takes place at the printing station. After the document D passes the printing line and through the printing station it is directed upwardly and out of the exit opening in the access cover 11. Alternatively, the document D can be directed outwardly beneath the access cover 11 and above the guide plates 48 overlying the upper peripheral portion of the pin wheel rolls 33. In this first feeding mode, the document D is drawn through the printer primarily by the friction drive roll segments 24, 26 and the pin wheel rolls 33 maintain the document D in the proper alignment as the document D is fed through the printer.

The continuous web document D can also be fed through the printer in a second feeding mode, as illustrated in FIG. 3, which is identical to the first feeding mode for the continuous document D except that the document is directed beneath the overlying guide plates 48 extending inwardly and overlying the upper peripheral portion of the pin wheel 33. This upper guide plate 48 forces the pin holes 30 back into engagement with the pins 34 on the pin wheel 33 and the length of the path of travel of the continuous document D from the time it is first engaged by the pins 34 until it is again engaged by the pins 34 is slightly less than the distance between the corresponding pin feed holes 30 so that the portion of the document extending through the printing station is held under tension to provide positive driving engagement of the continuous web document D both upstream and downstream of the printing station. This second feed mode for the continuous web document also permits positive reverse feeding of the continuous web document. Reverse feeding of the continuous web document D can be accomplished by rotation of a manual feed knob 52 (FIG. 1) fixed on the outwardly extending end of the pin wheel drive shaft 35. The feed knob 52 can also be used to feed the document in a forward direction through the printer. However, it is preferred that forward feeding be accomplished by use of a forward feed switch 53 on the front panel of the housing 10 (FIG. 1). The printer may also be provided with a reverse feed switch, not shown, for reversing the feeding direction of the pin wheels 33 and the friction drive rolls 24, 26, if desired.

FIG. 4 illustrates a second guide path which is provided for directing individual cut form documents, as indicated at C in FIG. 4, in a first feeding mode and directly into the friction drive rolls 24, 26 to thereby bypass the pin wheel 33. This first feeding mode for the individual cut form documents C is provided to permit the cut form documents C to be fed into the printer from above and either manually or from an automatic cut form document feeder, not shown. In this first feeding mode for cut form documents, the accesss cover 11 is first removed and the cut form document C is fed into the printer from above and along a path of travel spaced rearwardly of the path of entry of the continuous web document D so that the cut form document C is not engaged by the pin wheels 33 but is guided directly into the friction roll driving rolls 24, 26. As illustrated in FIG. 4, the cut form document C, such as a letterhead or the like, is fed downwardly in front of the downwardly inclined rear portion of the lower guide plate 44 so that it is directed downwardly beneath the surface of the friction drive roll 26 and then upwardly through the nip of the drive rolls 24, 26 to pass through the printing station and upwardly and out of the housing 10. As illustrated in FIG. 4, the cut form document C does not engage the pin wheel 33 and even if it did engage the pin wheel drive 33, it would not be advanced thereby since the cut form document C does not contain the pin wheel drive holes therein. While it is possible to manually feed cut form documents C into the printer from above and along this first feeding mode, the first feeding mode is provided particularly for use when automatically feeding cut form documents into the printer by an automatic document feeder of any conventional well known type.

The second feeding mode for cut form documents C is illustrated in FIG. 5 and is of particular value when letters are printed on stationery and an envelope is then fed to the printing station for imprinting the address of the recipient thereon. In this second feeding mode, the cut form document C is manually fed into the front of the printer and along a path of travel directly into the nip of the friction feed rolls 24, 26. The cut form document C is placed on the forward end of the lower guide 44 and with one edge against the guide ledge 45 (FIG. 1) and the leading edge of the cut form document C is moved inwardly into engagement with the nip of the friction drive rolls 24, 26 so that it is then fed upwardly through the printing station and between the platen 14 and the print head 13. The wide mouth or opening provided between the lower surface of the forward end of the lower guide 44 and the forward end of the upper front guide 46 permits short documents, such as envelopes and the like to be manually fed inwardly by the fingers of the operator a sufficient distance that the leading edge of the short document will engage the nip of the friction drive rolls 24, 26.

In conventional types of printers, the print head 13 is normally supported in a horizontal plane for back and forth movement and the platen 14 is supported in a vertical position. In order to provide the wide mouth or opening in the front of the printer, in accordance with the present invention, the print head 13 is supported at an inclined angle of approximately 30 degrees from the horizontal and the platen 14 is supported at right angles thereto. This up-ward tilting of the print head 13 and the associated drive shaft 20 and ribbon cartridge 22 also provides easier access for the operator to remove the access cover 11 and change the carbon ribbon cartridge 22, when necessary.

Thus, in the multifunction document transport system of the the present invention, documents can be fed through the printer in four different feeding modes to provide improved versatility to the printer. In the first and second feeding modes for a continuous web document, the continuous web document is fed into the printer from the top and first engages and is guided in proper feeding alignment by means of pin wheels into the friction roll drive means and then through the printing station and out of the printer. In the first feeding mode for the cut form documents, the cut form documents are fed into the printer from the top and along a different entry path from the continuous web document so that the cut form documents are not engaged by the pin wheel driving means before they are fed into the friction roll driving means. In the second feeding mode for the cut form documents, the cut form documents are fed into the printer from the front and are guided directly into the friction roll driving means and the guide plates for guiding the cut form documents inwardly from the front of the printer are spaced apart at their forward ends to provide a wide opening or mouth for insertion of the fingers of the operator so that short cut form documents, such as envelopes and the like, may be manually fed directly into the friction roll driving means. The positioning of the nip of the friction roll driving means closely adjacent and in advance of the printing line also permits the printing on a document to be spaced as close as approximately one-half inch from the top and bottom of the cut form document.

In the drawings and specification, there has been set forth the best mode presently contemplated for the practice of the present invention, and although specific terms are employed, they are used in a generic and descriptive sense only and not for purposes of limitation, the scope of the invention being defined in the claims.

That which is claimed is:

1. An output printer for a computer or a data processing machine comprising a printing station having printer means for recording data on a document, and a platen supported rearwardly of and in alignment with said printer means and over which the document moves during its travel through said printing station, drivingly engaged friction roll driving means positioned immediately in advance of said printing station for advancing the document between said printer means and said platen, Pin wheel driving means positioned in advance of said drivingly engaged friction roll driving means for advancing a document of the continuous web type having uniformly spaced pin feed holes in its outer edges, and document guide means for facilitating the optional feeding of a continuous web document, the feeding of individual cut form documents, or the simultaneous feeding of both continuous web type and cut form documents while printing on only the cut form documents, said document guide means including means for directing the continuous web document along a path of travel with the uniformly spaced pin feed holes engaging said pin wheel driving means and then between said drivingly engaged friction roll driving means, said document guide means further including a cut form document receiving opening in the front of said printer for receiving and directing individual cut form documents inwardly from the front of said printer and along a path of travel directly into said drivingly engaged friction roll driving means without operatively engaging said pin wheel driving means, said cut form document receiving opening being positioned to direct the cut form documents through said printing station in a position forwardly of any continuous web document being fed through said printing station.

2. An output printer according to claim 1 wherein said printer means is supported at a downwardly inclined angle and wherein said document guide means includes a lower guide extending inwardly from the lower end of said cut form document receiving opening in the front of said printer and curving upwardly to direct cut form documents into said friction roll driving means, and an upper guide having a forward end portion spaced above said lower guide and extending along the upper end of said cut form document receiving opening to provide an open mouth extending across the front of said printer, said upper guide having a rearward end portion spaced closely adjacent and following the curved contour of the rearward portion of said lower guide, the open mouth between the forward end portions of said upper and lower guides permitting entry of the fingers of the operator to facilitate the placement of the leading edge of short cut form documents, such as envelopes, directly into said friction roll driving means.

3. An output printer according to claim 1 wherein said document guide means for individual cut form documents includes guide means extending downwardly from the top of said printer and rearwardly of said pin wheel driving means for directing the individual cut form documents directly into said friction roll driving means.

4. An output printer according to claim 1 wherein said friction roll driving means comprises friction drive rolls forming a feeding nip through which the cut form documents are fed to said printing station, and wherein said feeding nip is positioned within approximately one-half inch of said printing station so that the first and last lines of print on cut form documents can be formed within approximately one-half inch of the respective leading and trailing edges of the cut form documents.

5. An output printer for a computer or a data processing machine including a printing station having printer means for recording data on a document, and a platen supported in alignment with said printer means and over which the document moves during its travel through said printing station, drivingly engaged friction roll driving means positioned immediately in advance of said printing station for advancing the document between said printer means and said platen, pin wheel driving means positioned in advance of said drivingly engaged friction roll driving means for advancing a document of the continuous web type having uniformly spaced pin feed holes in its outer edges, and document guide means for facilitating the optional feeding of a continuous web document or the feeding of individual cut form documents, said document guide means including first guide path means being operable for directing the continuous web document along a feeding mode of travel with the uniformly spaced pin feed holes engaging said pin wheel driving means and then between said drivingly engaged friction roll driving means, and second guide path means being operable for directing individual cut form documents along a first feeding mode of travel extending downwardly from the top of said printer, rearwardly of said pin wheel driving means, directly into said drivingly engaged friction roll driving means, and through said printer station, and said second guide path reans also being operable for directing cut form documents along a second feeding mode of travel extending inwardly from the front of said printer, directly into said drivingly engaged friction roll driving means, and through said printing station.

6. An output printer according to claim 5 wherein said friction roll driving means comprises first friction roll means positioned to engage one face of the document immediately in advance of said platen, and second friction roll means positioned to engage the opposite face of the document immediately in advance of said platen thereby forming a friction roll driving nip through which the document passes immediately in advance of said printing station, and wherein said first guide path means for directing the continuous web document along a feeding mode of travel includes a first curved guide associated with said pin wheel driving means for maintaining the uniformly spaced pin feed holes in engagement with said pin wheel driving means along a path extending partially around the circumference of said pin wheel driving means and toward said friction roll driving nip, and a second curved guide spaced closely adjacent a portion of the peripheral surface of said second friction roll means for directing the continuous web document beneath said second friction roll means and into said friction roll driving nip.

7. An output printer according to claim 5 wherein said second guide path means for directing individual cut form documents along a first feeding mode of travel comprises an extension of said second curved guide and extending downwardly from the top of said printer and rearwardly in spaced relationship from said first guide means and in spaced relationship from said pin wheel driving means for directing cut form documents directly into said friction roll driving nip and thereby bypassing said pin wheel driving means.

8. An output printer according to claim 7 wherein said second guide path means for directing individual cut documents along a second feeding mode of travel comprises an extension of said second curved guide and extending inwardly from the front of said printer for directing cut form documents directly into said friction roll driving means.

* * * * *